US006938422B2

(12) United States Patent
Thorn

(10) Patent No.: US 6,938,422 B2
(45) Date of Patent: Sep. 6, 2005

(54) AMBIENT ENERGY FUELED MECHANICAL AND ELECTRIC POWER PLANT (AEFMEPP)

(76) Inventor: Jeffrey P. Thorn, 950 Washington Ave., Albany, NY (US) 12203

( * ) Notice: Subject to any disclaimer, the term of this patent is extended or adjusted under 35 U.S.C. 154(b) by 132 days.

(21) Appl. No.: 10/694,230

(22) Filed: Oct. 28, 2003

(65) Prior Publication Data

US 2005/0086938 A1 Apr. 28, 2005

(51) Int. Cl.[7] ..... F01K 25/08
(52) U.S. Cl. ..... 60/651; 60/671
(58) Field of Search ..... 60/645, 670, 651, 60/671, 649

(56) References Cited

U.S. PATENT DOCUMENTS 3,704,586 A * 12/1972 Bruns ..... 60/39.182
3,872,682 A * 3/1975 Shook ..... 62/114
4,041,708 A * 8/1977 Wolff ..... 60/649
4,516,402 A * 5/1985 Chang ..... 60/656
4,541,246 A * 9/1985 Chang ..... 60/648
5,233,823 A * 8/1993 Day ..... 60/775
5,685,152 A * 11/1997 Sterling ..... 60/641.8
6,158,237 A * 12/2000 Riffat et al. ..... 62/484
6,591,614 B2 * 7/2003 Smith et al. ..... 62/3.1

* cited by examiner

*Primary Examiner*—Hoang Nguyen

(57) ABSTRACT

A system for generating mechanical and or electric power using low grade thermal or electro-magnetic energy reservoirs, such as air, water and incident light to fuel the power generation cycle. The system performs in a manor similar to a refrigeration cycle. But the system differs from a refrigeration cycle because the system extracts the thermal energy absorbed from the reservoir and energy of compression using the turbine/motor. Greater than 105% of the energy for compression will be available from the system when the appropriate system geometrics are used.

6 Claims, 1 Drawing Sheet

Qa - Energy transferred from the energy reservoir.
Qc - Energy input by the compressor.
Component 1 - Evaporator.
Component 2 - Compressor.
Component 3 - Reservoir.
Component 4 - Flow control valve.
Component 5 - Turbine system.
Component 6 - Power system interface.
Component 7 - Generator.

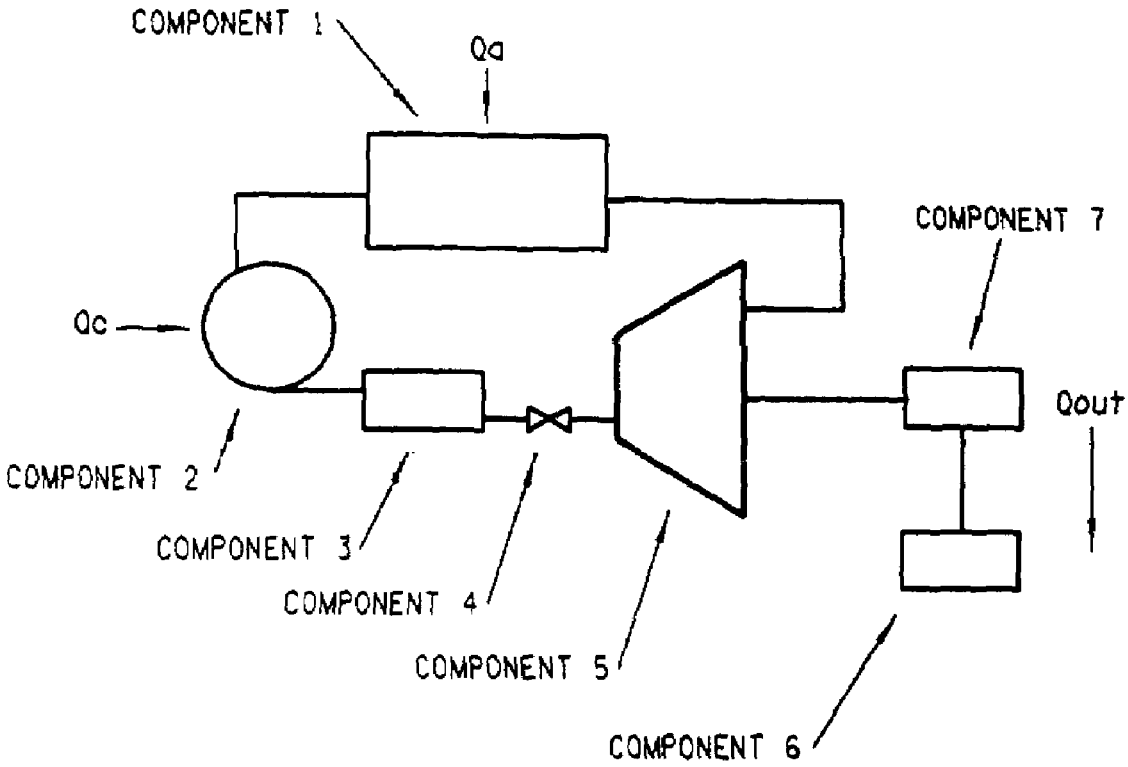
Qa - Energy transferred from the energy reservoir.
Qc - Energy input by the compressor.
Component 1 - Evaporator.
Component 2 - Compressor.
Component 3 - Reservoir.
Component 4 - Flow control valve.
Component 5 - Turbine system.
Component 6 - Power system interface.
Component 7 - Generator.

AMBIENT ENERGY FUELED MECHANICAL AND ELECTRIC POWER PLANT (AEFMEPP)

BACKGROUND OF THE INVENTION

This application addresses an power generating system encompassed by U.S. patent class 60—"power plant" subclassification 641.1—"utilizing natural heat". The fuel for the AEFMEPP system is thermal energy/heat that is present in any environment even if temperatures in the area where the device is deployed is below zero Celsius.

DESCRIPTION OF PRIOR ART AND TECHNOLOGIES

U.S. Pat. Nos. 4,280,327, 4,262,484 and 4,907,410 document systems that take advantage of low grade energy resources. The low grade energy sources include solar radiation and residual thermal energy in liquids and gases. But, those patents document systems that deliver energy to the working fluid/prime mover while the working fluid is in the high pressure portion of the generation cycle. This application embodies the absorption of thermal energy in the low pressure portion of the closed working fluid cycle.

The innovations of this patent for "Ambient Energy Fueled Mechanical and Electric Power Plant" (AEPMEPP) can mitigate dependence on fossil fuels and can provide a scalable power system that can be deployed almost anywhere using ambient energy in the environment as the fuel for the cycle. Since the system absorbs energy from an energy reservoir such as the environment these systems can also perform or be retrofitted to air conditioning, refrigeration, cooling tower or other systems while performing the primary function of mechanical and or electric power generation.

SUMMARY OF THE INVENTION

"Ambient Energy Fueled Mechanical and Electric Power Plant" (AEFMEPP) generates mechanical and electric power from ambient energy in the environment. The AEFMEPP ability to mitigate dependence on fossil fuel results from the fact that thermal and other ambient energy is available everywhere even in very cold environments. Therefore the power which can be created for any location using the AEFMEPP is not dependent on the traditional fuel supply, since the fuel to power the cycle is available every.

The AEFMEPP power cycle is an improvement over standard power generation cycles since the fuel to power the cycle is free in air, water or other environmental sources and the working fluid absorbs power from the environment in a manor similar to a "refrigerant" in the low pressure portion of the cycle. The system to extract power (SEP) from the working fluid, similar to a turbine system, extracts both the energy of compression and fluid vaporization as the working fluid passed through the SEP.

AEFMEPPs can in theory be constructed using commercially available equipment and working knowledge. But since the AEFMEPP will be built of a scale appropriate for specific applications it is probable that custom manufactured components will be used in most AEFMEPPs deployments.

BRIEF DESCRIPTION OF DRAWING

In the "Ambient Energy Fueled Mechanical and Electric Power Generating System" drawing, Qa represents the thermal energy transferred from the energy reservoir per pound mass of working fluid. The energy reservoir could include air, water or any other "fluid"; an air conditioning system thermal load; a refrigeration system thermal load; energy to be extracted from a cooling/condensation tower and or incident electromagnetic energy.

Qc represents the energy added to the working fluid by the compressor per pound mass of working fluid.

Component 1—The evaporator/heat exchanger of predetermined shape and size, allows energy from the energy reservoir to flow into the working fluid. The amount of heat transferred from the thermal reservoir to the fluid, via component 1, is denoted in the diagram by Qa.

Component 2—The means for increasing the pressure of the working fluid in the vaporous state, increases the pressure on the working fluid vapor. Qc represents the energy added to the working fluid by component 2 which will usually be a compressor.

Component 3—The reservoir, which is insulated, allows the superheated working fluid compressed by, component 2 to pass to component 5. This reservoir is distinctly different from the condenser used in air conditioning and refrigeration equipment since no heat transfer from the fluids occurs in component 3 for this system.

Component 4—The flow control system, assures proper mass flow needed for fluctuating reservoir and evaporator temperature. System embodiments could include computer controlled compressor speed and various "flow control valves".

Component 5—The method for extracting energy from the working fluid, most commonly implemented as a turbine system, reduces the internal energy of the working fluid as it passes from the reservoir component 3 and to evaporator component 1. The pressure difference between the reservoir and the evaporator is maintained by the design of the system that sizes all system components based on the available ambient energy and desired power output. The evaporator design assures that the pressure at the exhaust from the turbine is appropriate to assure the power output of the turbine. When the working fluid leaves the turbine system 5, it returns to the evaporator for "reheating".

Component 6—The power system interface connects to the power grid or battery system.

Component 7—The generator, creates electrical power from the mechanical power from the turbine system 5. The output of the generator connected directly to the power system interface, component 6. Qout, the power output of the system, is dependent on the efficiency of the total cycle, turbine and generator. Qout for the system will be at least 105% of Qc and closer to 80% of Qa+Qc for larger scale system implementations.

DETAILED DESCRIPTION OF INVENTION

The Ambient Energy Fueled Mechanical and Electric Power Plant (AEFMEPP), as described in this application, can be fabricated, by someone with knowledge of the arts of turbine and refrigeration system design, using the information provided in this application. The references provided in the "References" section of this application provide an introduction the fundamental knowledge of thermodynamics, turbine technology and compressor performance data that someone new to the art of turbine and power system design can use to design and fabricate an AEFMEPP for their specific site characteristics.

Fuel/energy for the power generation cycle can be obtained from the residual thermal energy in air, water, refrigeration loads, air conditioning loads, cooling towers and or solar energy sources.

The working fluid which moves in a forced closed cycle, absorbs thermal energy from the environment, through the evaporator, component 1, in a manor similar to a refrigerant. Qa represents the power absorbed from the environment and transferred to the power generation cycle. The evaporator performs in a manor similar the evaporator of a standard refrigeration cycle except that the dimensions of the evaporator are designed to assure the proper pressure and temperature drop across the turbine.

In a standard system design, similar to a standard refrigeration system design, Qa is approximately 4 times Qc, the energy added to the forced closed cycle via the compressor, component 2 of the system diagram. For a standard design a 1 horse power compressor (42.4 BTU/min) would facilitate absorption of 1 ton (200 BTU/min) of thermal energy from the environment via the evaporator.

After absorbing Qa, which corresponds to approximately the energy of vaporization for the fluid, from the energy reservoir the vapor in the evaporator is pass through the compressor, component 2, which adds an amount of power Qc to the working fluid. Since this system does not exhaust thermal energy to the environment most standard refrigeration compressors can not be used for this system configuration because those compressors don't operate at the elevated temperatures that result from not exhausting heat in a manor similar to a standard refrigeration cycle. Most standard refrigeration compressors have thermal overload circuits or parts that can not endure the elevated temperatures.

The reservoir, component 3, provides the method for connecting the compressor to the turbine. Component 4, the flow control system is represented diagrammatically as one unit but can be embodied as either a traditional flow control valve selected based on the mass flow required for the system or embodied as a variable speed compressor. The control process would respond to the changes in ambient temperature and therefore the rate of heat transfer that occurs via the evaporator.

The "turbine system", component 5, in a standard system design would provide the mechanical power and connects to the generator. The mass flow, pressure and temperature parameters for the location specific deployment can be provided to commercial manufacturers of turbine systems in order have a turbine manufactured for the specific system needs. The majority of standard turbine systems are not designed to support condensation within the turbine therefore care must be exercised that the pressure and temperatures specified for the system assure that condensation in the turbine does not occur.

Most turbine manufacturers can package the turbine with couplings for mechanical power output and with generators to provide the electric power. For a standard system, Qout, the power output from the electric generator should range between 3 to 4.5 times Qc, the power consumed by the compressor when all of the turbine power is directed to the electric power generator. The efficiency of cycle expressed relative to Qc is dependent on how well the flow control system controls mass flow in response to temperature changes; the efficiency of the turbine in extracting power from the working fluid based on the specified system parameters and the efficiency of the generator in converting mechanical to electrical power.

When designing an AEFMEPP cycle evaporator dimensions assures the rate of power delivered to the system in worst case performance situations and the pressure differential needed by the turbine to create power. Standard thermodynamic and Bernoulli equations can be used to estimate initial system parameters. Then consultation with manufacturers who specialize in components of the appropriate size for the specified application can assure the performance specifications for their equipment and the final evaporator performance requirements and dimensions for the evaporator.

The "control valve system", component 4, enables the system to operate efficiently over a wide temperature range. The control valve system, as defined here, controls the mass flow rate of the working fluid via either the control valve or the compressor speed. Variations in the mass flow rate can be used to maintain the efficiency of the system when the energy reservoir experiences changes in temperature and therefore available energy.

Predetermined working fluids that perform like refrigerants, substances with pressure enthalpy relationships similar to ammonia, Freon 12, ethane, etc. are the preferred working fluids for embodiments of this invention. The choice of refrigerant to be used as a working fluid is dependent on the predetermined temperature range, available materials for system construction or load conditions. Performance specifications for standard equipment configurations and working fluids can be noted in the references sited.

For an AEFMEPP using ammonia as a working fluid the pressure for the compressor suction inlet in the low pressure portion of the cycle and compressor high pressure exhaust portions of a standard predetermined cycle are approximately 34.3 pounds per square inch (psi) and approximately 169 psi respectively. The energy absorbed from a thermal energy reservoir at 5 degrees Fahrenheit would be, approximately Qa=200 Btu/(min*Lb NH3). The energy consumed by the compressor would be approximately Qc=42 Btu/(min*Lb NH3). With an appropriately designed turbine system 85%++ percent of Qa+Qc could be extracted for mechanical and electric power applications. Note consultation with the turbine supplier will be needed to assure that the pressure at the exhaust of the turbine/inlet to the evaporator is set appropriately for maximum turbine efficiency. Note, the geometry of the reservoir, component 3, needs to be of a predetermined shape in order for the system to performed as described.

What is claimed is:

1. An ambient energy fuel mechanical and electric power generating system comprising:

a) a closed working fluid cycle that absorbs energy from an ambient energy source including air in the environment, in a heat absorption process using refrigerant as a working fluid, and transfers said energy to a power extracting means of a predetermined capacity for generating electricity, said power extracting means including an energy storing means;

b) means for absorbing energy Qa from said ambient energy from the environment, and for transferring a predetermined amount of energy from the ambient energy reservoir to the refrigerant;

c) means for compressing said refrigerant by an energy Qc for increasing the pressure of the refrigerant to a predetermined pressure, for connecting and maintaining the pressure difference between said energy absorbing/transferring means and the compressing means;

d) a working fluid reservoir, insulated to prevent energy loss, for connecting said compressing means to said energy extracting means;

e) means for controlling the predetermined pressure difference between high and low pressure portions of the cycle;

f) said power extracting means extracting an amount of energy greater than 105% of the compressing energy Qc after the cycle is operated so that the refrigerant is circulated from said high pressure portion to said low pressure portion of the cycle.

2. A power generating system of claim 1 wherein said ambient energy source is selected from a group consisting of air, water, sunlight, or any combination of the elements listed in this group.

3. A power generating system of claim 1, wherein said energy absorbing/transferring means is selected from a group consisting of a heat exchanger of an industrial process, an evaporator of an air conditioning system, an evaporator of a refrigeration system, or a heat exchanger on a condensation tower.

4. A power generating system of claim 1, wherein said power extracting means is a turbo machinery device being selected from a group consisting of a turbine, a heat engine, or thermodynamic based motor.

5. A power generating system of claim 1, wherein said power extracting means comprises a turbine generator set.

6. A power generating system of claim 1, wherein said means for maintaining pressure difference comprises a temperature sensitive flow control valve placed at the inlet of said power extracting means with sensors placed along the flow path of the refrigerant.

* * * * *